US007604308B2

(12) United States Patent
Tseng et al.

(10) Patent No.: US 7,604,308 B2
(45) Date of Patent: Oct. 20, 2009

(54) LATCH AND RELEASE DEVICE OF A SLIDE ASSEMBLY

(75) Inventors: I-Ming Tseng, Kaohsiung Hsien (TW); Wei-Sheng Wang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 508 days.

(21) Appl. No.: 11/603,831

(22) Filed: Nov. 24, 2006

(65) Prior Publication Data

US 2008/0122333 A1 May 29, 2008

(51) Int. Cl.
*A47B 88/00* (2006.01)

(52) U.S. Cl. ..... 312/333; 312/334.46

(58) Field of Classification Search ..... 312/333, 312/334.44–334.47, 319.1, 334.1, 334.7, 312/265.1–265.4; 384/21
See application file for complete search history.

(56) References Cited

U.S. PATENT DOCUMENTS 5,033,805 A 7/1991 Hobbs
5,085,523 A * 2/1992 Hobbs ..... 384/21
5,262,923 A * 11/1993 Batta et al. ..... 361/679.37
5,653,518 A * 8/1997 Hardt ..... 312/334.4
6,249,430 B1 * 6/2001 Huang et al. ..... 361/679.31
6,297,962 B1 * 10/2001 Johnson et al. ..... 361/726
6,373,707 B1 * 4/2002 Hutchins ..... 361/725
6,398,041 B1 6/2002 Abbott
6,456,501 B1 * 9/2002 Rubenstein et al. ..... 361/759
6,883,884 B2 4/2005 Chen et al.
6,929,336 B2 8/2005 Liu et al.
6,930,887 B2 * 8/2005 Hartman ..... 361/727
6,999,309 B2 * 2/2006 Hsu ..... 361/679.38
7,318,532 B1 * 1/2008 Lee et al. ..... 211/26
7,364,244 B2 * 4/2008 Sandoval ..... 312/333
7,467,833 B2 * 12/2008 Weng ..... 312/221
2004/0227443 A1 * 11/2004 Sandoval ..... 312/334.44
2005/0029913 A1 * 2/2005 He ..... 312/334.44
2008/0067907 A1 * 3/2008 Chen et al. ..... 312/312
2008/0203251 A1 * 8/2008 Chen et al. ..... 248/200
2008/0303397 A1 * 12/2008 Chen et al. ..... 312/334.46
2009/0102339 A1 * 4/2009 Weng ..... 312/333

* cited by examiner

*Primary Examiner*—Janet M Wilkens
(74) *Attorney, Agent, or Firm*—Rosenberg, Klein & Lee

(57) ABSTRACT

A latch and release device of a slide assembly includes a resilient catch, a press button, and a mounting base. The resilient catch has a first end and a second end opposite to each other and a locking portion. The first end of the resilient catch is fixed to the slide assembly. The locking portion prevents the slide assembly from extending. The press button is disposed with a locating hole. The mounting base has a chamber to receive the press button and allow the press button to slide therein. The mounting base is disposed with an opening corresponding in position to the locating hole of the press button for the second end of the resilient catch to penetrate through the opening and to be secured in the locating hole of the press button.

10 Claims, 9 Drawing Sheets

LATCH AND RELEASE DEVICE OF A SLIDE ASSEMBLY

BACKGROUND OF THE INVENTION (a) Field of the Invention

The present invention relates to a latch and release device of a slide assembly, and more particularly, to one that is capable of releasing a resilient catch fixed on the slide assembly by pressing a press button sliding in a mounting base connected to the slide assembly without using any tool.

(b) Description of the Prior Art

As taught in U.S. Pat. No. 5,033,805, a locking and release device generally available in the market has a locking member disposed at the front end of the slide to restrict its drawer track and a middle track, and the middle track and a cabinet track are secured to each other. A drawer or a similar object is connected to a slide, and the slide is mounted to a post by means of a locking device from the drawer or its similar object as disclosed in U.S. Pat. No. 6,398,041 B1. As disclosed in U.S. Pat. No. 6,883,884 B2, a bolting structure is disposed at the front end of an inner track of a slide to be locked to a locating position when the slide is retracted. Furthermore, U.S. Pat. No. 6,929,336 B2 discloses a server is mounted to a post by means of a slide with a fastening member disposed at the front end of the server to secure the server to a metallic plate on the post when the server is retracted.

In the prior art, the locking structure is found in excessively large in volume, the structure of components tends to complicate, or the releasing operation is not convenient whether the locking of the slide, or the server or the similar object is mounted to the cabinet or a post by means of the slide before being interlocked with the post.

SUMMARY OF THE INVENTION

The primary purpose of the present invention is to provide a latch and release device of a slide assembly to solve the locking problem of the slide assembly by having inserting a press button into a mounting base connected to the slide assembly for the push button to slide in the mounting base, and a resilient catch to secure the slide assembly. By pressing the press button, the resilient catch is easily to be released without using any tool.

To achieve the purpose, the present invention includes a resilient catch, a press button, and a mounting base. The resilient catch has a first end and a second end opposite to each other and a locking portion. The first end of the resilient catch is fixed to a mobile track of the slide assembly. The locking portion restricts the mobile track from extending. The press button has a locating hole. The mounting base is fixed to a front end of the mobile track and provided with a chamber to accommodate the press button and allow it to slide therein. An opening is further disposed on the mounting base at where in relation to the locating hole of the press button. The second end of the resilient catch penetrates through the opening to be secured in the locating hole of the press button.

Wherein, the locking portion is made in a form of a raised ear having an oblique surface and a vertical surface with the latter holding against a locating portion.

Wherein, the locking portion is a through hole.

Wherein, the locating portion is a raised member protruding from the fixed track of the slide assembly.

Wherein, the locating portion is an opening disposed on the fixed track of the slide assembly.

Wherein, the locating portion is a protruded plate of a bracket and the bracket is connected to the fixed track of the slide assembly.

Wherein, the locating portion is a vertical side of a post.

Wherein, the mounting base is disposed with a slot for insertion of an insertion piece provided at the front end of the mobile track of the slide assembly.

Wherein, a first retainer and a second retainer are relatively disposed on the inner side of the mounting base and the insertion piece.

Wherein, the mounting base comprises insertion pins to hold against the inner side of the mobile track.

Accordingly, the present invention provides the following effects and advantages:

a. It allows easy, fast, safe, and comfortable operation to latch and release without using any tool;
b. Its components allow easy and simply assembly for cost reduction; and
c. It can be generally adapted to the locating purpose with a post, bracket or slide

DETAILED DESCRIPTION OF THE PREFERRED EMBODIMENTS

Figure 1:
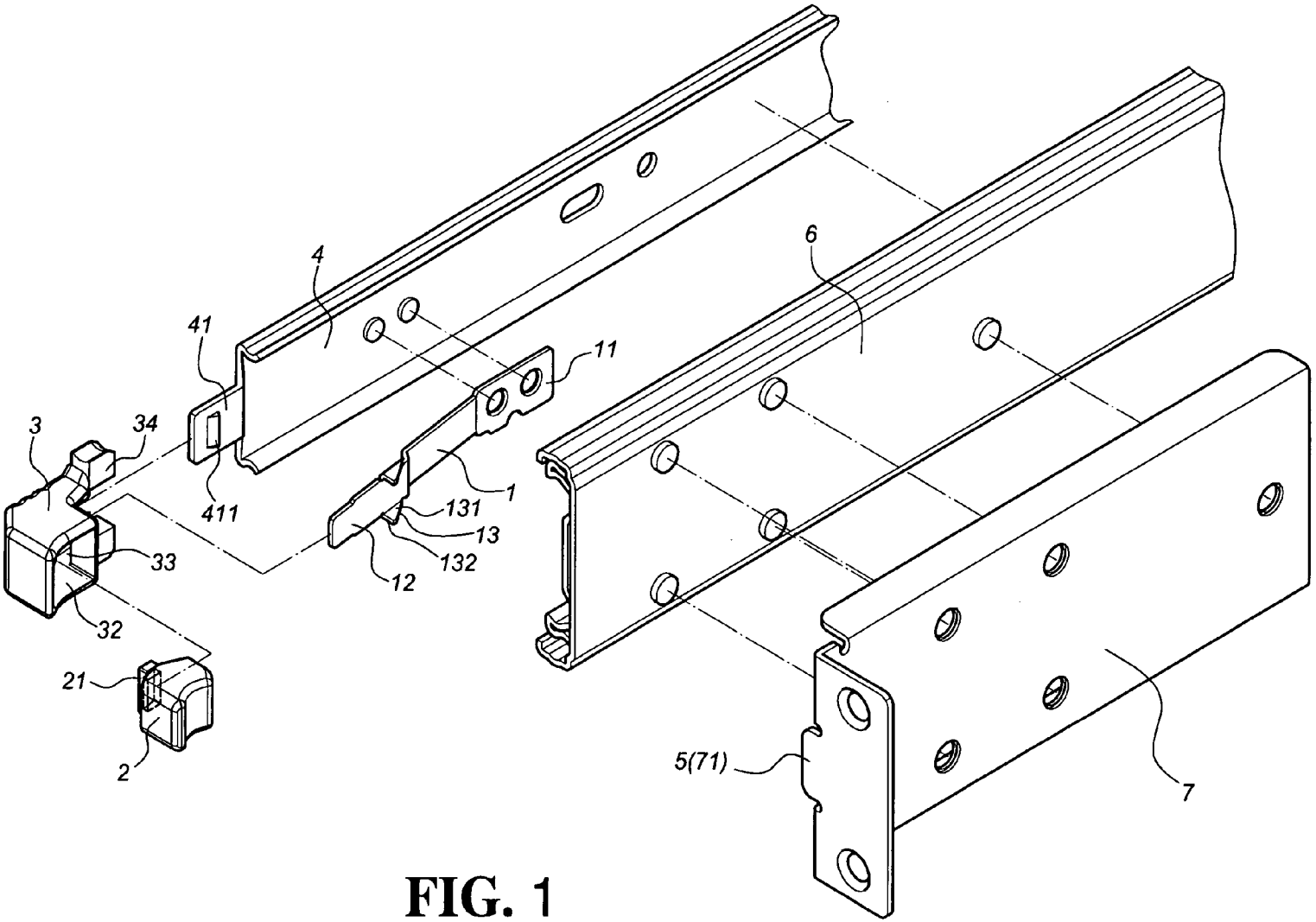
FIG. 1 is an exploded view of a preferred embodiment of the present invention.
Figure 2:
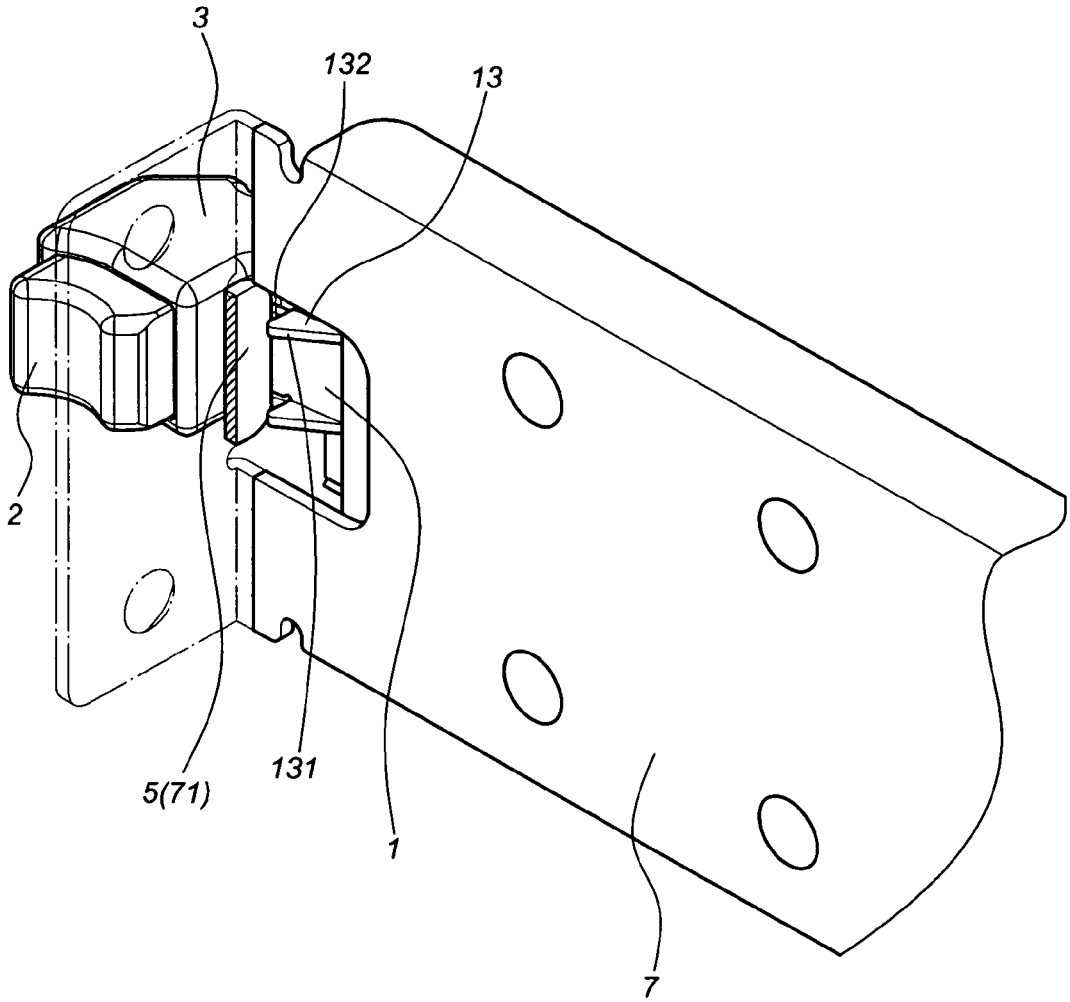
FIG. 2 is a schematic view showing the preferred embodiment of the present invention as assembled.

Referring to FIGS. 1 and 2, a preferred embodiment of the preset invention comprises a resilient catch (1), a press button (2), and a mounting base (3).

The resilient catch (1) has a first end (11), a second end (12), and a locking portion (13). Both the first end (11) and the second end (12) are disposed opposite to each other with the first end (11) fixed to a mobile track (4) of the slide assembly and holding against a locating portion (5) by means of the locking portion (13). The locking portion (13) indicating a shape of a raised ear has an oblique surface (131) and a vertical surface (132). The vertical surface (132) is to hold against the locating portion (5). In the preferred embodiment, the locating portion (5) is a protruded plate (71) of a bracket (7). The bracket (7) is connected to a fixed track (6) of the slide assembly.

The press button (2) has a locating hole (21).

Figure 3:
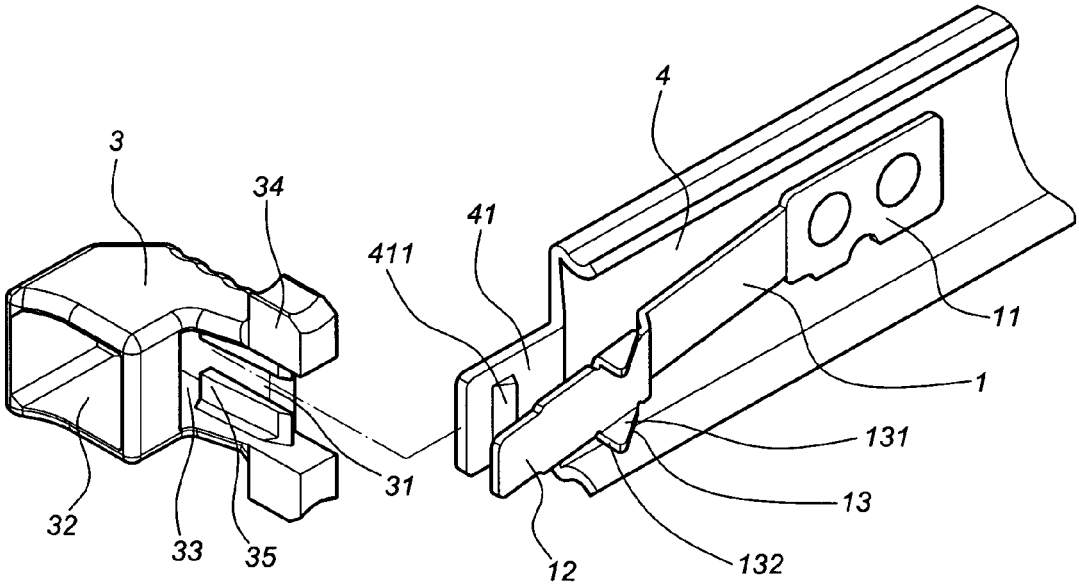
FIG. 3 is a schematic view taken from another angle showing a mounting base in the preferred embodiment of the present invention.

As illustrated in FIG. 3, the mounting base (3) comprises a slot (31) for insertion of an insertion piece (41) disposed on a front end of the mobile track (4), a chamber (32) to receive the press button (2) and allow it to slide therein, and an opening (33) corresponding in position to the locating hole (21) of the press button (2). The second end (12) of the resilient catch (1) is inserted through the opening (33) and secured in the locating hole (21) of the press button (2). The mounting base (3) further comprises two insertion pins (34) to interlock with the mobile track (4). A first retainer and a second retainer are relatively disposed in the slot (31) and on the insertion piece (41) to secure firmness of the connection between the mounting base (3) and the insertion piece (41) of the mobile track (4). In the preferred embodiment, the first retainer is a side wall (35) of the slot (31), and the second retainer is a protuberance (411) of the insertion piece (41).

Figure 4:
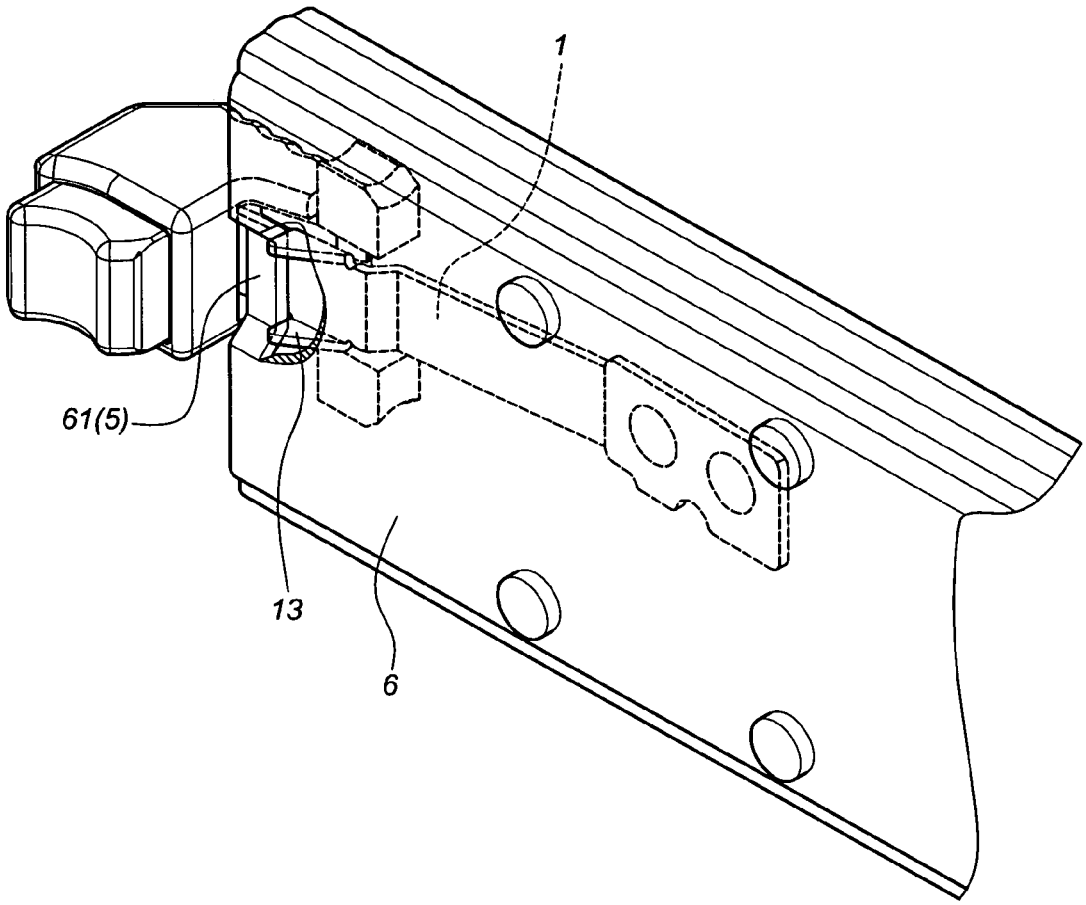
FIG. 4 is a schematic view showing that a locating portion related to a raised member is disposed on the fixed track in the preferred embodiment of the present invention.
Figure 5:
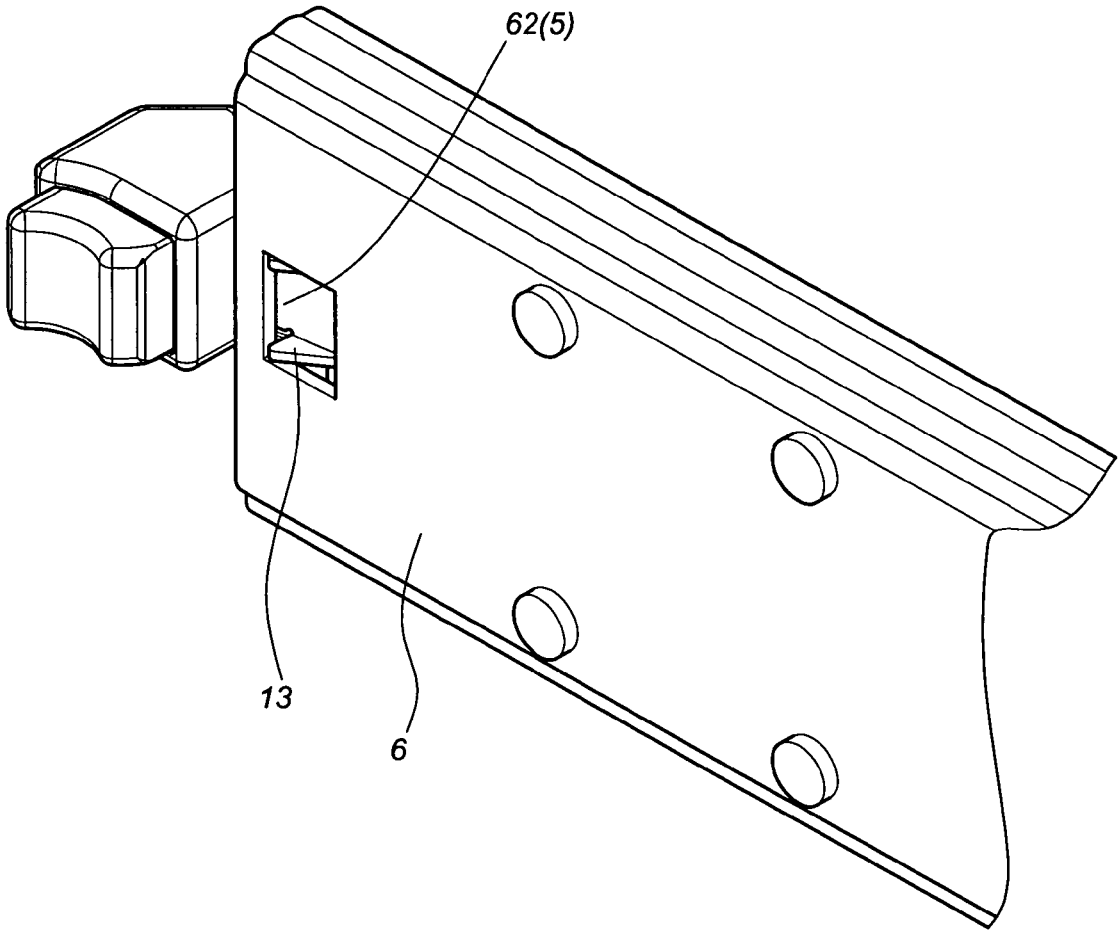
FIG. 5 is a schematic view showing that a locating portion related to an opening hole is disposed on the fixed track in the preferred embodiment of the present invention.

As illustrated in FIG. 4, the locating portion (5) may be a raised member (61) provided on the fixed track (6) of the slide assembly, and the locking portion (13) of the resilient catch (1) is also capable of locking to the raised member (61). As illustrated in FIG. 5, the locating portion (5) may be an opening (62) disposed on the fixed track (6) of the slide assembly.

Figure 6:
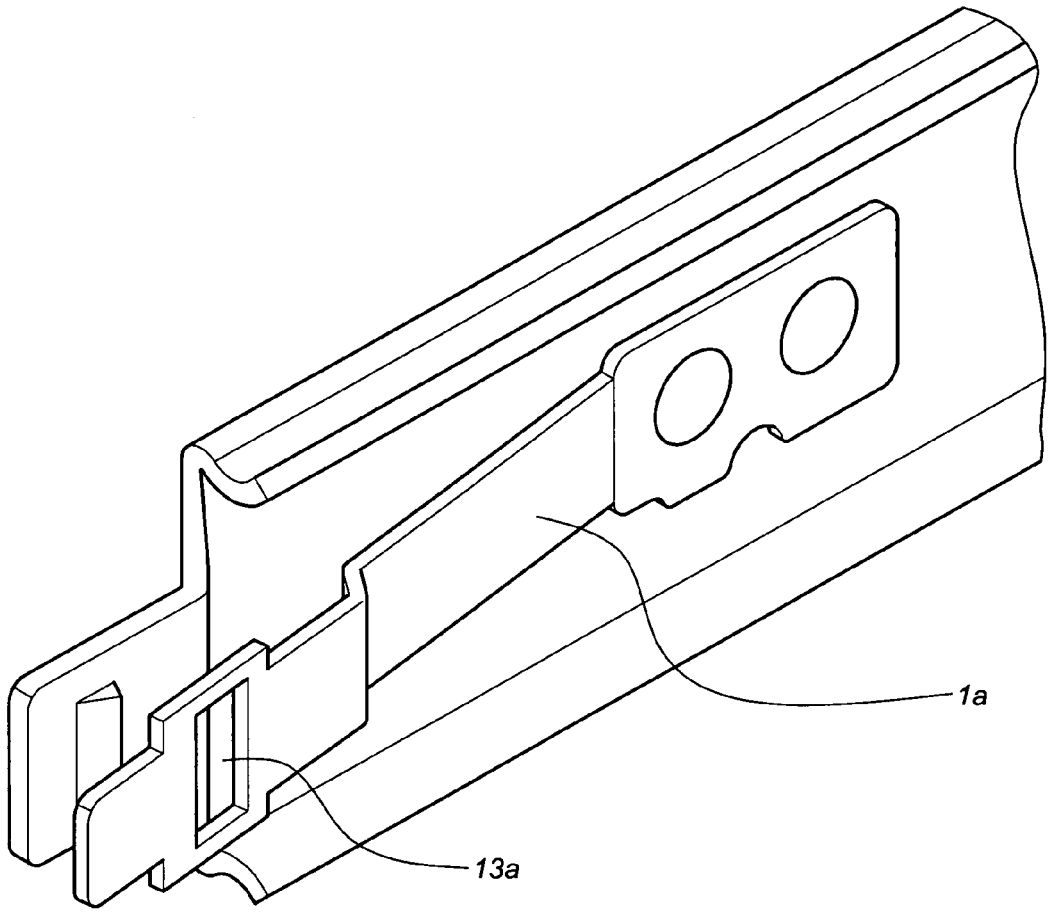
FIG. 6 is a schematic view showing that a locking portion in the preferred embodiment of the present invention is a through hole.

Now referring to another preferred embodiment of the present invention as illustrated in FIG. 6, a locking portion (13*a*) of a resilient catch (1*a*) is a through hole to be engaged by the protruded plate (71) of the bracket (7) or by the raised member (61) of the fixed track (6).

Figure 7:
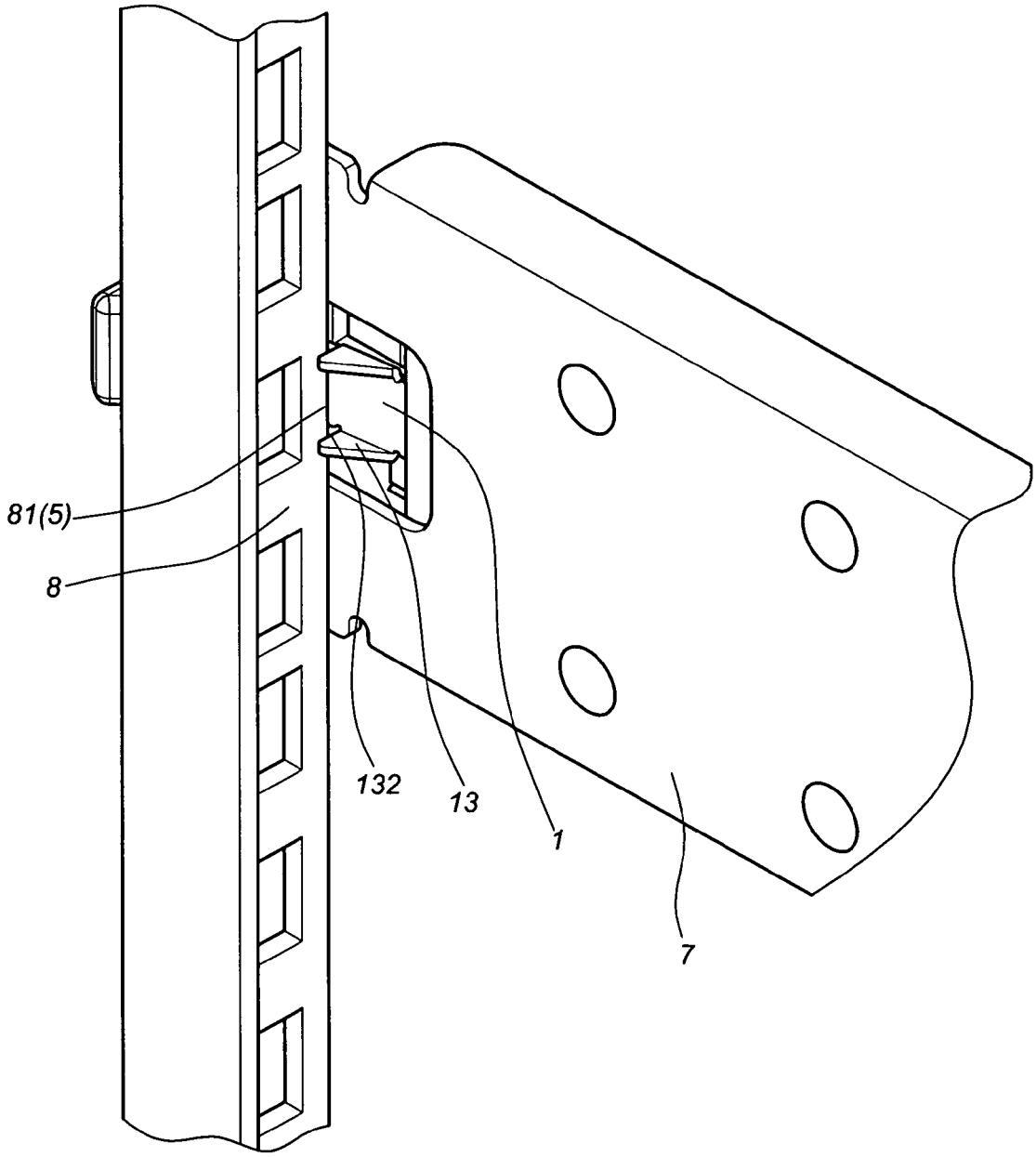
FIG. 7 is a schematic view showing that a locking portion of the preferred embodiment of the present invention is locked to a post and the locating portion is disposed on a vertical side of the post.

In another preferred embodiment of the present invention as illustrated in FIG. 7, the slide assembly connected with the bracket (7) is mounted on a post (8) by means of the vertical surface (132) of the locking portion (13) of the resilient catch (1) holding against a vertical side (81) of the post (8), that is, the vertical side (81) serves as the locating portion (5).

Figure 8:
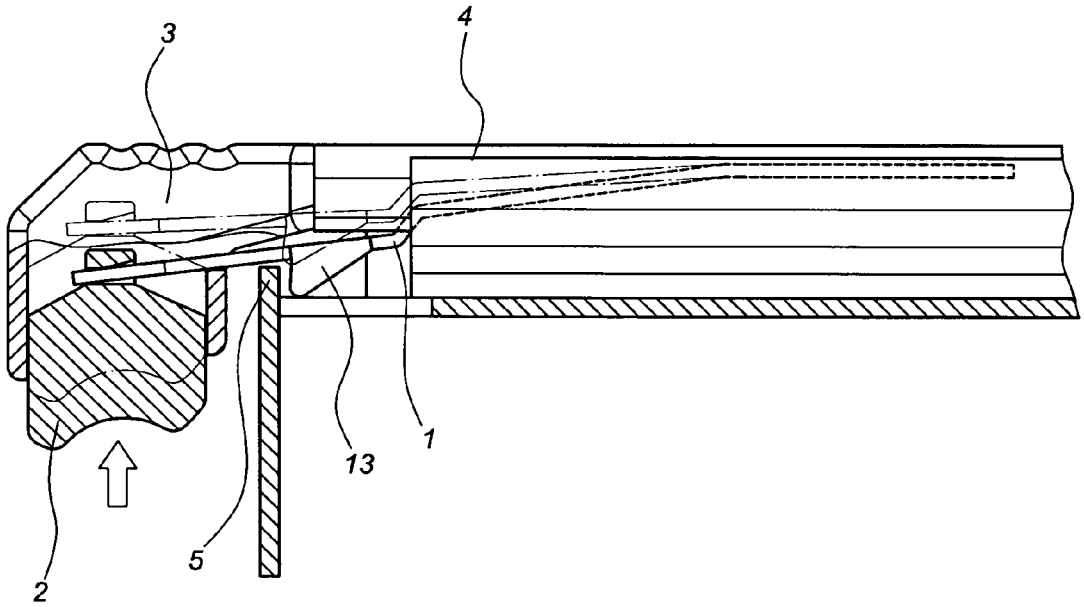
FIG. 8 is a schematic view showing an operation to release the resilient catch in the preferred embodiment of the present invention.

To extend the mobile track (4) by releasing the resilient catch (1) as illustrated in FIG. 8, the operator uses his/her finger to press the press button (2) disposed on the mounting base (3) for the press button (2) to push the locking portion (13) of the resilient catch (1) for it to disengage from the locating portion (5) thus to pull the mounting base (3) to extend the mobile track (4).

Figure 9:
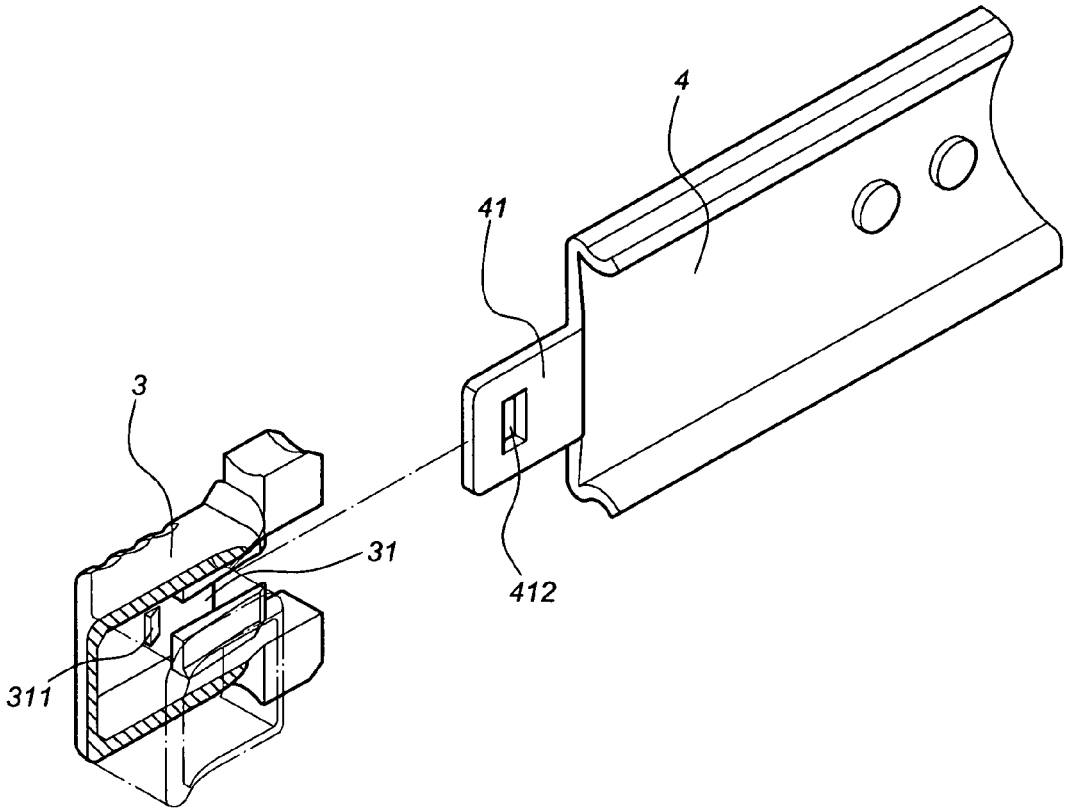
FIG. 9 is a schematic view showing a variation of the combination of a mounting base and an insertion piece of the mobile track in the present invention.

As illustrated in FIG. 9 for another preferred embodiment of the present invention, the first retainer of the mounting base (3) is a nipple protruding from the inner side of the slot (31), while the second retainer of the insertion piece (41) of the mobile track (4) is an opening (412). When the insertion piece (41) of the mobile track (4) is inserted into the mounting base (3), the opening (412) and the nipple (311) are interlocked to each other.

What is claimed is:

1. A latch and release device of a slide assembly comprising a resilient catch, a press button, and a mounting base;

the resilient catch having a first end and a second end opposite to each other, and a locking portion; the first end of the resilient catch being fixed to a mobile track of the slide assembly; the locking portion holding against a locating portion to prevent the mobile track from extending in relation to a fixed track of the slide assembly;

the press button having a locating hole;

the mounting base fixed to a front end of the mobile track comprising a chamber to receive the press button and allow the press button to slide therein and an opening corresponding in position to the locating hole of the press button, the second end of the resilient catch being inserted through the opening and secured in the locating hole of the press button.

2. The latch and release device of a slide assembly as claimed in claim 1, wherein the locking portion is a raised ear having an oblique surface and a vertical surface, the vertical surface holding against the locating portion.

3. The latch and release device of a slide assembly as claimed in claim 1, wherein the locking portion is a through hole.

4. The latch and release device of a slide assembly as claimed in claim 1, wherein the locating portion is a raised member disposed on the fixed track.

5. The latch and release device of a slide assembly as claimed in claim 1, wherein the locating portion is an opening disposed on the fixed track.

6. The latch and release device of a slide assembly as claimed in claim 1, wherein the locating portion is a protruded plate of a bracket connected to the fixed track.

7. The latch and release device of a slide assembly as claimed in claim 1, wherein the fixed track of the slide assembly is connected with a bracket, the bracket is mounted on a post, and the locating portion is a vertical side of the post.

8. The latch and release device of a slide assembly as claimed in claim 1, wherein the mounting base is provided with a slot for insertion of an insertion piece disposed on the front end of the mobile track.

9. The latch and release device of a slide assembly as claimed in claim 8, wherein a first retainer and a second retainer are relatively disposed on an inner side of the mounting base and the insertion piece.

10. The latch and release device of a slide assembly as claimed in claim 1, wherein the mounting base comprises insertion pins to hold against an inner side of the mobile track.

* * * * *